US007207148B2

(12) United States Patent
Surowiecki

(10) Patent No.: US 7,207,148 B2
(45) Date of Patent: Apr. 24, 2007

(54) WALL STRUCTURES

(76) Inventor: Matt F. Surowiecki, 22101 SE. 29th Pl., Sammamish, WA (US) 98075

( * ) Notice: Subject to any disclaimer, the term of this patent is extended or adjusted under 35 U.S.C. 154(b) by 694 days.

(21) Appl. No.: 10/694,583

(22) Filed: Oct. 24, 2003

(65) Prior Publication Data

US 2005/0086894 A1 Apr. 28, 2005

(51) Int. Cl.
*E04B 1/00* (2006.01)

(52) U.S. Cl. ..... 52/653.1; 52/736.2; 52/737.6; 52/737.2

(58) Field of Classification Search ..... 52/653.1, 52/649.6, 649.7, 637, 633, 692, 429, 481.1, 52/481.2, 729.3, 729.4, 730.2, 731.3, 736.2, 52/737.5, 737.6, 737.2, 762
See application file for complete search history.

(56) References Cited

U.S. PATENT DOCUMENTS

| | | | | | |
|---|---|---|---|---|---|
| 626,365 | A * | 6/1899 | Clavert | 52/737.2 |
| 1,818,418 | A * | 8/1931 | Millard | 52/263 |
| 2,574,074 | A * | 11/1951 | Vogel | 52/377 |
| 3,019,863 | A * | 2/1962 | Kearns, Jr. | 52/588.1 |
| 3,159,250 | A * | 12/1964 | Wilson | 52/301 |
| 3,358,848 | A * | 12/1967 | Johnsson | 211/190 |
| 3,623,290 | A * | 11/1971 | Downing, Jr. | 52/481.2 |
| 3,653,172 | A * | 4/1972 | Schwartz | 52/669 |
| 4,034,526 | A * | 7/1977 | Deslaugiers | 52/220.2 |
| 4,350,318 | A * | 9/1982 | Gallis | 249/40 |
| 4,697,393 | A * | 10/1987 | Madray | 52/93.2 |
| 5,050,358 | A * | 9/1991 | Vladislavic | 52/334 |
| 5,964,072 | A * | 10/1999 | Rasmussen | 52/666 |
| 6,272,796 | B1 * | 8/2001 | Metzler | 52/93.1 |
| 6,449,791 | B1 * | 9/2002 | Vodicka | 14/75 |
| 2002/0100229 | A1 * | 8/2002 | Chen et al. | 52/167.1 |
| 2003/0084637 | A1 * | 5/2003 | Daudet | 52/655.1 |

FOREIGN PATENT DOCUMENTS

| | | | |
|---|---|---|---|
| JP | 03151430 | A * | 6/1991 |
| JP | 04176929 | A * | 6/1992 |
| JP | 05044266 | A * | 2/1993 |
| JP | 05179701 | A * | 7/1993 |
| JP | 06101285 | A * | 4/1994 |
| WO | WO 9403687 | A1 * | 2/1994 |

* cited by examiner

*Primary Examiner*—Jeanette Chapman
(74) *Attorney, Agent, or Firm*—Delbert J. Barnard

(57) ABSTRACT

A downwardly opening upper channel member (10) is positioned above an upwardly opening lower channel member (12). A lower end portion of the stud (14) is received in the lower channel member (12). An insert (54) is received in the upper channel member (10) at the location of each stud (14). Each insert (54) cooperates with the flanges (20, 22) of the upper channel member (10) to form a plurality of vertical sockets (102), one for each of the studs (14). Upper end portions of the studs (14) extend into the sockets (102). In a wall construction, wall board sheeting (WS) is connected to the stud (14) and the lower channel member (12) but not to the upper channel member (10) or the insert (54). As a result, relative vertical movement is permitted between the upper channel member (10) and the rest of the wall which include the studs (14), the lower channel member (12) and the wall board sheeting (WS).

12 Claims, 5 Drawing Sheets

WALL STRUCTURES

TECHNICAL FIELD

This invention relates to wall structures composed of metal framing and wallboard sheeting connected to the framing. More particularly, it relates to a simple way of providing for relative movement between an upper channel member, or header, and the rest of the wall, in response to wall movement such as may occur during an earthquake, for example.

BACKGROUND OF THE INVENTION

It is well known to use metal framing in building wall construction. Commonly, the framing comprises a downwardly opening upper channel, or header, an upwardly opening upper channel, or footer, and vertical studs extending between the channels and having end portions that are within the channels. An advantage of using metal framing members is that they provide a strong frame structure that can be configured to accommodate for movement of the buildings such as occurs during an earthquake, without resulting in damage to the wall of which the framing is a part.

Typically, the upper channel member is secured to an upper concrete structure and the lower channel member is secured to a lower concrete structure. During an earthquake, and at other times as well, there is relative movement between the two concrete structures. It is necessary that the framing that extends between the concrete structures be able to accommodate the relative movement without damage to the framing and the wall of which it is a part. Relative movement between the two concrete structures can be caused by earthquakes, roof loads, expansion and contraction, loading and unloading upper floors in multistory buildings, settling, and wind loads, for example.

U.S. Pat. No. 5,127,203, granted Jul. 7, 1992, to Robert F. Paquette, and U.S. Pat. No. 5,127,760, granted Jul. 7, 1992, to Todd A. Brady, each discloses the use of vertical slots in the flanges of overhead channels, for receiving screws that are used to secure upper end portions of the studs to the overhead channels. The overhead channels are provided with a plurality of slots so that a stud can be selectively positioned at a number of locations along the channel length. Screw fasteners are inserted through the slots and are then screwed into the upper end portions of the studs. In response to movement of the building, the upper channel member is movable relative to the studs and the wallboard that is connected to the studs. A problem with this use of slots is that constructing the upper channel members to include the slots is an added expense. Also, the slots weaken the metal. It often becomes necessary to use a heavier gauge metal to compensate for the loss in strength caused by use of the slots. This adds addition expense as heavier gauge metal is more expensive than lighter gauge metal.

U.S. Pat. No. 5,685,121, granted Nov. 11, 1997, to Frank DeFrancesco and Joseph Domenick Palumbo, discloses a use of a two-section stud. The upper end of the upper section is an upper channel and the lower end of the lower section is in a lower channel. The upper section is telescopically received within the lower section and includes a pair of slots that extend throughout a substantial portion of the length of the upper section. A problem with this construction is that the location of the slots cannot be determined for sure and the fasteners used may end up securing the lower section to the upper section. The installers must place the wallboard sheeting on the studs and then drill through the sheeting and the outer flange of the lower section of the stud at locations which are outwardly of the slots in the upper sections of the studs. If a screw fastener is not in alignment with a slot, it will screw into the metal bordering the slot. As a result, the upper and lower sections of the stud will be screwed together and relative movement between the two will be prevented. In such an event, the two sections of the stud are not free to move relative to each other in response to seismic or other forces to which the wall may be subjected. Also, it is difficult and expensive to make the long slots, to provide the upper section with a flared upper end, and to provide the upper section with the longitudinal V-shaped flanges that are a part of the system. Also, considerable more steel is needed in a wall that uses the two-section stud of this system.

There is a need for a wall construction that permits movement of the upper channel member relative to the rest of the wall in a positive manner without adding substantial manufacturing and/or installation costs. A principal object of the present invention is to provide such a wall structure.

BRIEF SUMMARY OF THE INVENTION

A wall structure to which the present invention relates comprises a downwardly opening upper channel member that includes an upper web and a pair of spaced apart side flanges depending from the upper web to the lower edges. The upper web and the side flanges form a channel space below the upper web and between the side flanges. The wall structure also includes a plurality of vertically extending studs that are horizontally spaced apart. Each stud includes an upper end portion and an upper butt end. The upper end portions of the studs are received in the channel space, with the butt ends of the studs positioned below the web of the upper channel member and above the lower edges of the side flanges of the upper channel member. According to the invention, each stud is provided with an insert that fits in the channel space of the upper channel member.

Each inserts forms with the upper channel member a downwardly opening socket in which the upper end portion of a stud is received. The end portion of the stud preferably makes a snug or clearance fit with the walls of the socket. It is not desirable that the upper end portion of the stud be too loose in the socket and it must be capable of moving up and down in the socket relative to the upper channel member and the insert. There can be frictional forces acting between the upper end portion of the stud and the walls of the socket, but the frictional forces cannot be so large that they prevent relative movement between the stud and the assembly formed by the upper channel member and the insert.

In preferred form, each insert comprises a pair of end portions. Each end portion has a web and a pair of flanges projecting from the web in a direction opposite the flanges of the other end portion. A top web section interconnects the webs of the two end portions. The two end portions of the insert and the upper channel member form a socket that is bounded at the top by the web section, at its sides by the webs of the two end portions, and on its front and back by the flanges of the upper channel member. The insert is positioned within the channel space of the upper channel member. The flanges of the end portions of the insert are contiguous the flanges of the upper channel member and the web section is contiguous with the web of the upper channel member. In preferred form, each insert includes lips that are connected to the flanges of the inserts. The lips are parallel to each other and to the webs of the inserts.

According to an aspect of the invention, the wall structure further comprises an upwardly opening lower channel member including a lower web and a pair of spaced apart side flanges projecting upwardly from the lower web. The lower web and the side flanges form a channel space above the lower web and between the side flanges. The studs have lower end portions that are placed in the channel space of the lower channel member and are connected to the lower channel member. The connection may be by the use of screws which extend through the flanges of the lower channel member and screw into the flanges of the lower end portion of the stud.

In preferred form, the same stock material used to form the studs is used to form the inserts. This stock material has a web, a pair of flanges that are connected to the web and extend perpendicular to it and parallel to each other, and a pair of lips that are connected to the flanges. The lips extend inwardly from the flanges towards each other in co-planar parallelism. They are spaced in parallelism with the web. A length of this lipped channel member is cut to form recesses in its flanges and lips between the two end portions of the channel member. The end portions of the channel member are then bent perpendicular to a web section between them that is retained and used to connect the two end portions together. The end portions extend perpendicular to this web section. Accordingly, the end portions of the insert are of channel form and include lips on the flanges. The lips on the end portions of the inserts strengthen the regions of the upper channel member to which the insert is connected. The end portions of the inserts also brace the sockets which receive the upper end portions of the studs.

Other objects, advantages, and features of the invention will become apparent from the detailed description that is set forth below, from the drawings, and from the claims.

BRIEF DESCRIPTION OF THE SEVERAL VIEWS OF THE DRAWING

Like reference numerals are used to designate like parts throughout the several views of the drawing.

DETAILED DESCRIPTION OF THE PREFERRED EMBODIMENT

Figure 1:
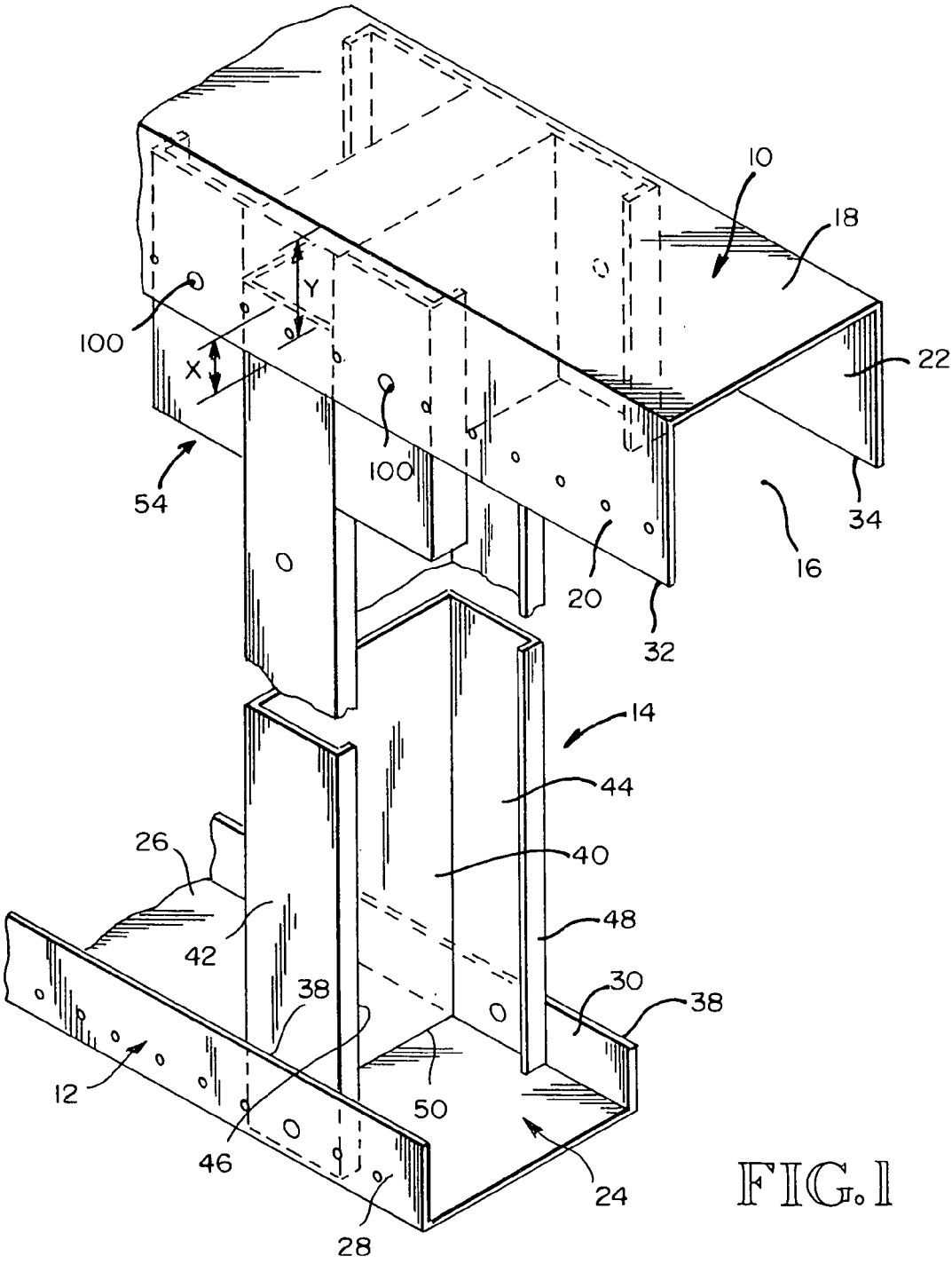
FIG. 1 is a fragmentary pictorial view looking towards the assembly of an upper channel member, a lower channel member, a stud having an upper end portion, and an insert in said upper channel members said insert being connected to the upper channel member, said view being taken from above the assembly with the mid portion of the stud being broken away for purpose of indicating indeterminate length.
Figure 2:
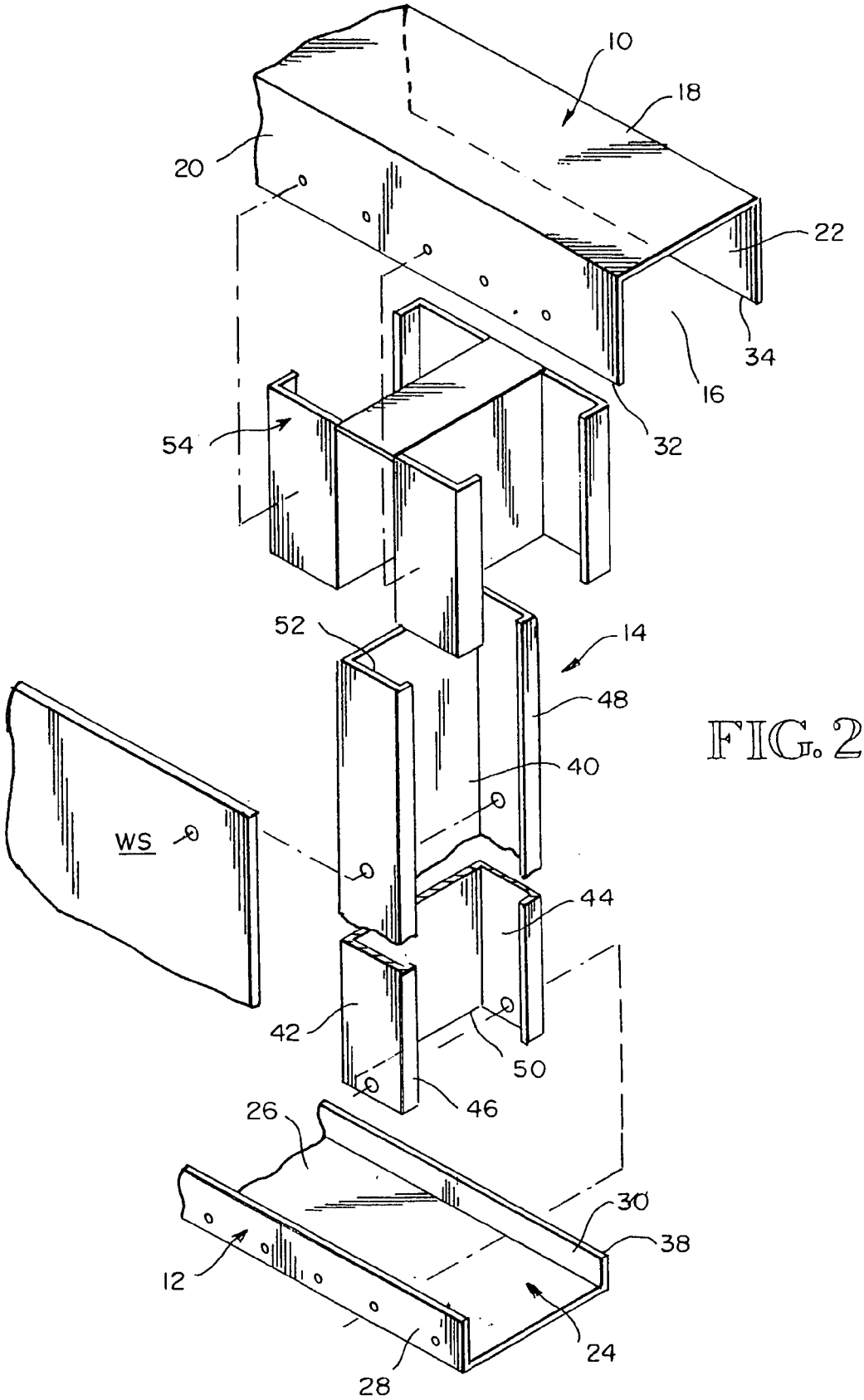
FIG. 2 is an exploded pictorial view of the assembly shown by FIG. 1, such view including a fragmentary portion of some sheeting that is connected to the stud.
Figure 3:
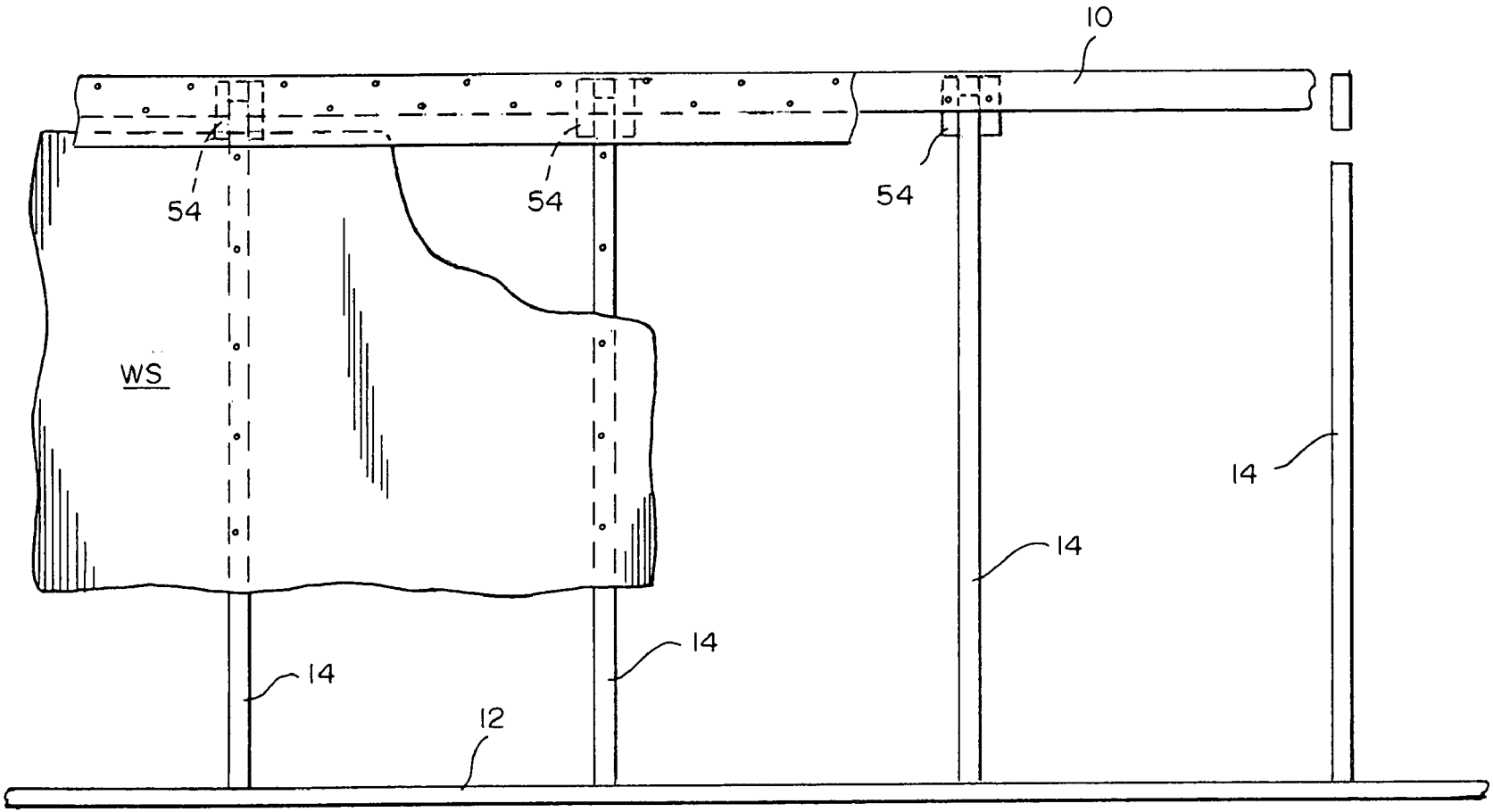
FIG. 3 is a fragmentary side elevational view looking towards framing composed of an upper channel, a lower channel, a plurality studs extending between the two channels and sheeting connected to the studs.

FIGS. 1–3 show wall framing comprising an upper sheet metal channel member 10, a lower sheet metal channel member 12 and a plurality of sheet metal studs 14 that are supported at their lower ends in the channel 12 and at their upper ends project into a channel space 16 formed below an upper web 18 and between the pair of side flanges 20, 22 that depend from the web 18. The lower channel 12 includes a channel space 24 that is defined above a lower web 26 and between a pair of side flanges 28, 30 that project upwardly from the lower web 26. The upper flanges 20, 22 include lower edges 32, 34. The lower flanges 28, 30 include upper edges 36, 38. As shown by FIG. 3, a plurality of sheet metal studs 14 are spaced apart along the channels 10, 12. The studs 14 are parallel to each other and are perpendicular to the channels 10, 12.

Referring to FIGS. 1 and 2, in particular, each stud 14 includes a web 40, front and rear (or first and second) flanges 42, 44 and a pair of lips 46, 48. The flanges 42, 44 are parallel to each other and are perpendicular to the web 40. The lips 46, 48 are in spaced, co-planar parallelism with each other and are perpendicular to the flanges 42, 44. They are also parallel to the web 40. The front to rear dimension of the studs 14 substantially equals the distance between the side flanges 28, 30 of the lower channel member 12. Web 40 and lips 46, 48 extend perpendicular to the upper side flanges 20, 22 and the lower side flanges 28, 30. Each stud 14 includes a lower butt end 50 and an upper butt end 52 (FIG. 2). Butt end 50 preferably rests on the web 26, butt end 52 is spaced above the lower edges 32, 34 a distance x and below the upper web 18, a distance y. The dimensions x, y are variable dimensions. This is because the framing permits relative vertical movement between the upper channel 10 and the wall structure that includes the studs 14 and the lower channel member 12. FIG. 1 shows an at-rest position. When the wall structure is in this position, the dimension x is smaller than the dimension y but is large enough to provide substantial lateral bracing between the upper end portions of the studs 14 and the side flanges 20, 22 of the upper channel member 10.

According to the invention, a separate insert 54 is provided for each stud 12. Each insert has an upper portion that extends upwardly into the channel space 16 and a lower portion that extends downwardly below the edges 32, 34. The upper portions of the inserts 54 are connected to the upper channel member 10, and move with it but are free of connection to its stud 14.

The wall framing structure that has been described so far is like the wall framing structure disclosed in co-pending application Ser. No. 10/125,293, filed Apr. 17, 2002, and entitled "Wall Construction," except for the construction of the insert and its relationship to the studs 14. The disclosure of Ser. No. 10/125,293 is hereby incorporated herein by this specific reference to that application.

Figure 4:
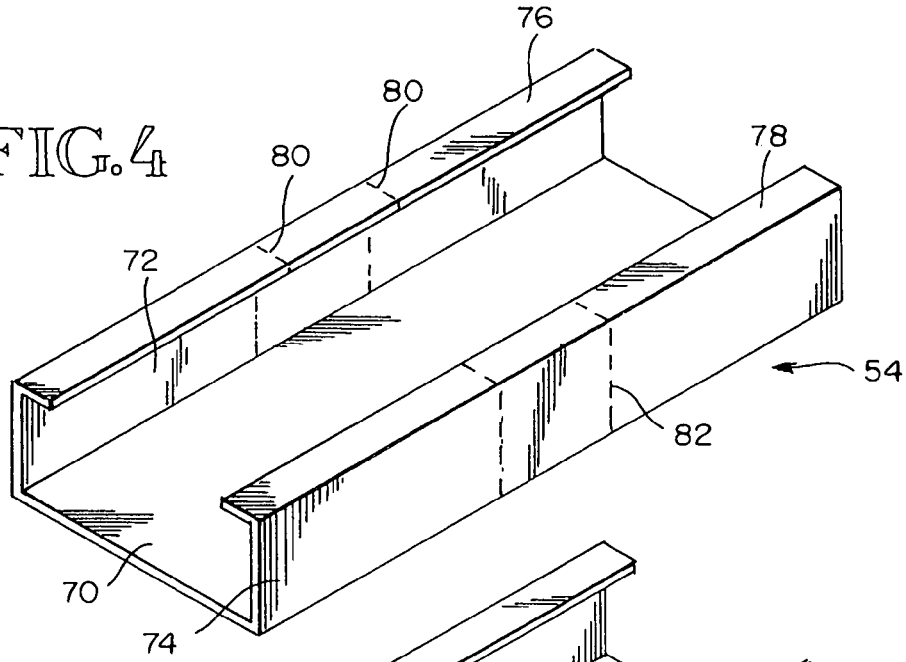
FIG. 4 is a pictorial view looking towards a length of lipped channel, such view including broken lines indicating where the flange and lip portions of the channel are to be cut.
Figure 5:
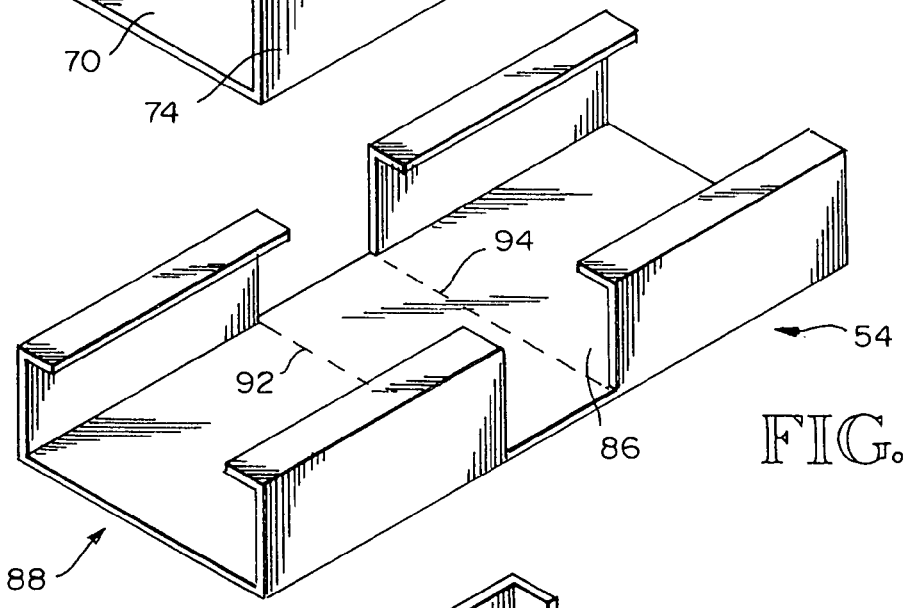
FIG. 5 is a view like FIG. 4, but showing the channel member cut at the location of the broken lines in FIG. 4 and showing mid-portions of the flanges and lips that were between the lines removed from the rest of the channel, such view showing additional broken lines where the web portion of the channel member is to be bent.
Figure 6:
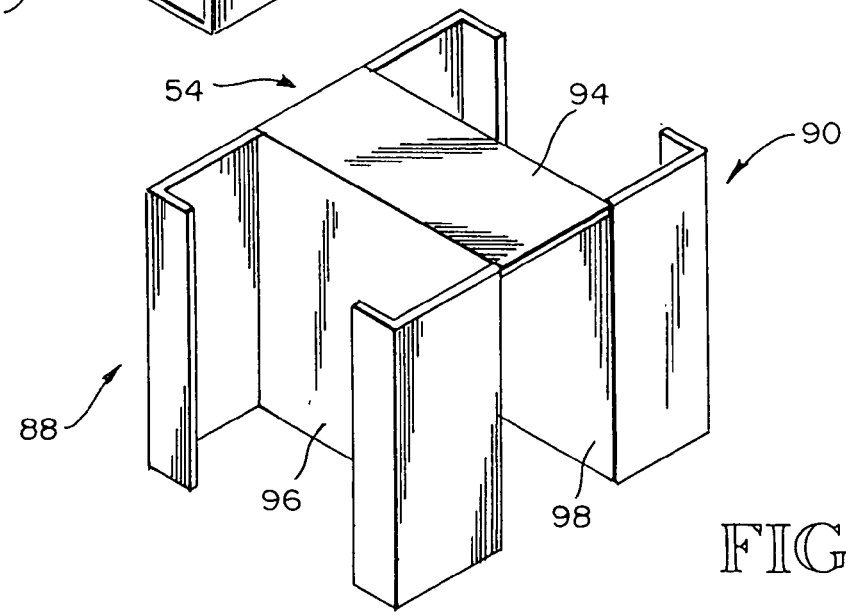
FIG. 6 is a view like FIGS. 4 and 5, but showing the end portions of the channel member bent downwardly around the broken lines that are shown by FIG. 5.

FIGS. 4–6 show a preferred embodiment of the insert 54 and the manner in which it is constructed. Referring to FIG. 4, a length of lipped channel stock is used to make the insert 54. This length of lipped channel has the same cross sectional shape and dimensions as the lipped channels that are used to make the studs 14. It has a web 70, flanges 72, 74 and lips 76, 78. Flanges 72, 74 are perpendicular to the web 70. Lips 76, 78 are parallel to each other and are parallel to the web 70. Lips 76, 80 are perpendicular to the flanges 72, 74. Broken lines 80, 82 are shown in FIG. 4. The lips 76, 78 and the flanges 72, 74 are cut at these broken lines 80, 82. The flange and lip material between the broken lines is separated from the web 70, so as to create spaces 84, 86. The spaces 84, 86 divide the member 54 into two end portions 88, 90. After the member 54 is given the shape shown in FIG. 5, it is bent at the broken lines 92, 94 so as to form the shape shown by FIG. 6. This shape includes a web section 94 that is a part of the web 70. In FIG. 6, the portion of web 70 that is a part of end portion 88 is designated 96. The portion of web 70 that is a part of end portion 90 is designated 98.

Figure 7:
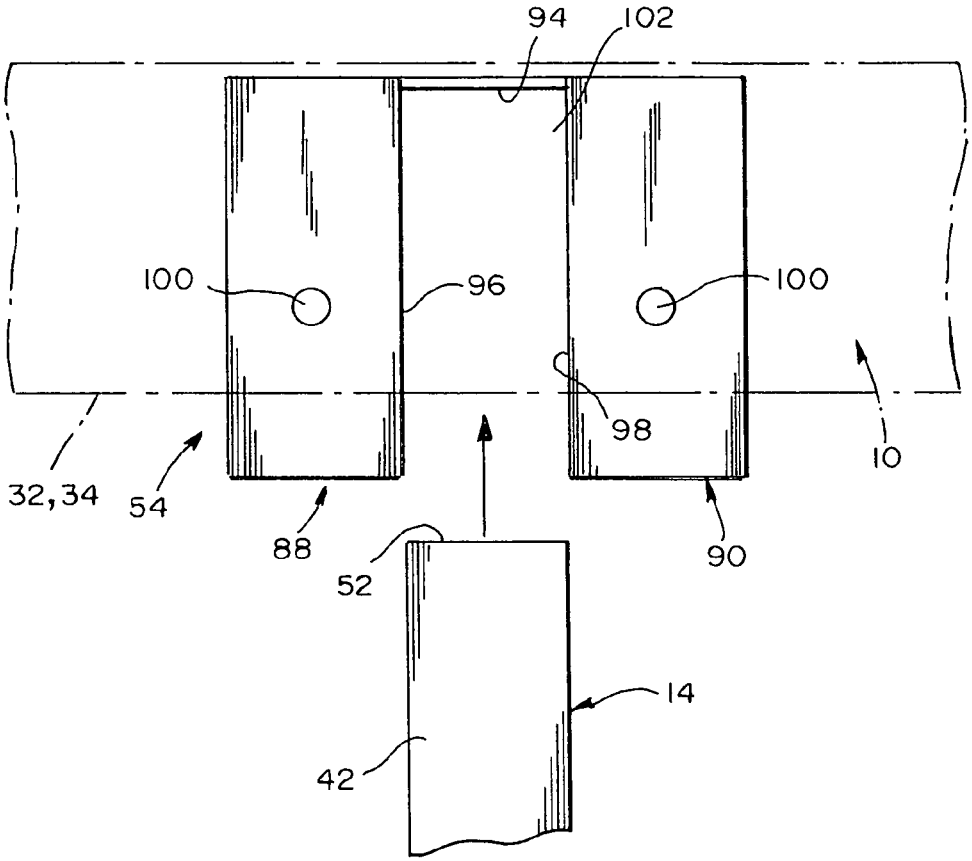
FIG. 7 is a side elevational view showing the insert of FIG. 6 positioned within the upper channel member, and showing the upper end portion of the stud in the process of being moved upwardly into a socket that is formed by and between the two end portions of the clip and by and between the flanges of the upper channel member.
Figure 8:
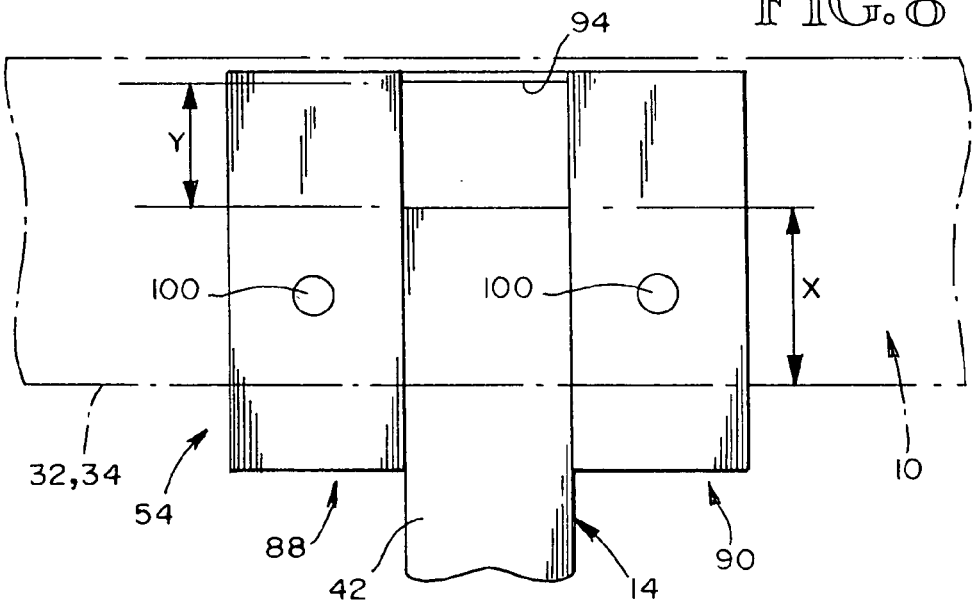
FIG. 8 is a view like FIG. 7, but showing the upper end portion of the stud moved upwardly into the socket formed by the end portions of the clip.

FIG. 7 shows the insert 54 positioned within the channel space 16 of the upper channel member 10. The web section 94 is moved upwardly into contact or near contact with the web 18 of channel member 10. Screw fasteners 100 may be used to connect the insert 54 to the upper channel member 10. The screw fasteners extend through the flanges 20, 22 and then screw into the flanges 72, 74. The end portions 88, 90 of the insert 54 extend vertically and are preferably long enough that they have lower end parts that depend below the edges 32, 34. When inside the upper channel member 10, the insert 54 forms with the channel 10 a socket 102 that is adapted to receive the upper end portion of the stud 14. The socket 102 is formed on its side by the web portions 96, 98. It is formed on the top by the web section 94. It is formed front and back by portions of the flanges 20, 22. Preferably, each socket 102 is sized such that the upper end portion of its stud 14 will make a clearance fit with the walls of the socket 102. However, the fit may be somewhat snug provided that the stud 14 can still move up and down in the socket 102. The upper channel member 10 and the insert 54 either move or are at rest together. The stud 14 and the lower channel member 12 either move or are at rest together. There is relative movement between the two assemblies where the upper end portion of the stud 14 is in the socket 102. The web section 94 is moved upwardly into contact or near contact with the web 18 of channel member 10.

The framing is covered, usually on both sides, by wall board sheeting WS or some other form of sheeting. Typically, the sheeting comes in sheets measuring four feet by eight feet, or four feet by ten feet, or four feet by twelve feet, for example. The thickness varies, for example, from one-half inch to five eights of an inch to three-quarters of an inch. The wall board sheeting WS is secured to the studs 14, preferably by screw fasteners, as is known by those skilled in the art. These screw fasteners extend through the wall board sheeting WS and screw into the flanges 42, 44 of the studs 14. However, the top portions of the sheeting WS is not secured to the upper channel member 10. The wall board sheeting WS is secured to the studs 14 and may be secured to the side flanges 28, 30 of the lower channel member 12. As shown by FIG. 1, a vertical space is formed between the upper butt ends of the studs 14 and the web 18 of the upper channel member 10. The wall board sheeting WS is connected to the studs 14, but is not connected to the inserts 54 or the upper channel member 10. As explained, the upper end portion of the studs 14 are telescopically received in the sockets that are formed by the inserts 54 and the upper channel member 10. The "box" shape of the inserts 54 provide rigid reinforced regions at each location where an upper end portion of a stud 14 enters into the channel space 60. Movement of the upper end portions of the studs 14 is resisted in all directions except for vertical translation of the studs 14 in the sockets 102.

The static distance between the lower edges of 32, 34 of the side flanges 20, 22 is preferably about one and one-half inches. The studs, the inserts and the upper and lower channel members are all formed from between twelve and twenty-six gauge sheet metal.

The illustrated embodiment is only one example of the present invention and, therefore, us non-limited. It is to be understood that many changes in the particular structure, materials, and features of the invention may be made without departing from the spirit and scope of the invention. Therefore, it is my intention that my patent rights not be limited by the particular embodiment that is illustrated and described herein, but rather such rights are to be determined by the following claims, interpreted according to accepted doctrines of patent claim interpretation, including use of the Doctrine of Equivalence and Reversal of Parts.

Preferably, the channel members 10, 12 are provided with a series of dents 102. The screws 100 are placed in a pair of these dents 102. The chosen dents 102 guide the screws 100 as they are rotated to drill into the metal 20, 54. The making and use of the dents 102 are set forth in my companion application entitled structural walls. This application is hereby incorporated herein by this specific reference.

What is claimed is:

1. A wall structure, comprising:

a downwardly opening upper channel member including an upper web and a pair of spaced apart side flanges depending from the upper web to lower edges, said upper web and side flanges forming a channel space below the upper web and between the side flanges;

a plurality of horizontally spaced apart, vertically extending studs, each said stud including an upper end portion;

a plurality of inserts, one for each stud, each said insert comprising a pair of end portions, each end portion having a web and a pair of flanges projecting from the web in a direction opposite the flanges of the other end portion, and a top web section interconnecting the webs of the two end portions, and with the end portions and the upper channel member forming a socket that is bounded at the top by the web section, at its sides by the webs of the two end portions, and on its front and back by the flanges of the upper channel member;

said insert being positioned within the channel space of the upper channel member, with the flanges of the end portions of the insert contiguous the flanges of the upper channel member and the web section is contiguous with the web of the upper channel member;

said upper end portions of said studs being received in the sockets;

said studs being free of connection to the inserts and the upper channel member; and said studs being moveable up and down in the sockets relative to both the insert and the upper channel member.

2. The wall structure of claim 1, wherein each insert includes lips that are connected to the flanges of the inserts, said lips being parallel to each other and to the webs of the inserts.

3. The wall structure of claim 2, wherein the inserts are connected to the upper channel member.

4. The wall structure of claim 3, wherein the inserts are connected to the flanges of the upper channel member.

5. The wall structure of claim 4, wherein the inserts are connected to the flanges of the upper channel member by screws.

6. The wall structure of claim 1, further comprising a lower channel member including a lower web and a pair of spaced apart side flanges projecting upwardly from the lower web, said lower web and said side flanges forming a channel space above the lower web and between the side flanges; and said studs having lower end portions that are in the channel space of the lower channel member and are connected to the lower channel member.

7. The wall structure of claim 6, comprising screws extending through the side flanges of the lower channel member and the flanges of the studs, for connecting the lower end of the studs to the lower channel member.

8. The wall structure of claim 6, wherein each insert includes lips that are connected to the flanges of the inserts, said lips being parallel to each other and to the webs of the inserts.

9. The wall structure of claim 8, wherein the inserts are connected to the upper channel member.

10. The wall structure of claim 9, wherein the inserts are connected to the flanges of the upper channel member.

11. The wall structure of claim 10, wherein the inserts are connected to the flanges of the upper channel member by screws.

12. The wall structure of claim 11, comprising screws extending through the side flanges of the lower channel member and the flanges of the studs, for connecting the lower ends of the studs to the lower channel member.

* * * * *